United States Patent [19]

Radke

[11] Patent Number: 4,726,352

[45] Date of Patent: Feb. 23, 1988

[54] CONTAINER ASSEMBLY

[75] Inventor: George F. Radke, Tsawwassen, Canada

[73] Assignee: Force 10 Marine Ltd., Vancouver, Canada

[21] Appl. No.: 910,152

[22] Filed: Sep. 19, 1986

[51] Int. Cl.[4] ..... F23M 7/00; F24C 15/04

[52] U.S. Cl. ..... 126/190; 126/194; 126/24; 126/191; 312/322

[58] Field of Search ..... 126/190, 191, 194, 198, 126/197, 193, 200, 24, 39 R, 90, 41 D, 340; 312/322, 323, 312, 331, 138 R; 49/254, 258

[56] References Cited

U.S. PATENT DOCUMENTS

| | | | |
|---|---|---|---|
| 479,857 | 8/1892 | Tettlebach | 126/190 |
| 608,050 | 7/1898 | Johnson | 126/24 |
| 1,855,759 | 4/1932 | Hofferber | 126/190 |
| 2,925,081 | 2/1960 | Shooter | 126/190 |
| 3,127,889 | 4/1964 | Mills | 126/190 |
| 3,838,538 | 10/1974 | Burford | 49/258 |

FOREIGN PATENT DOCUMENTS

| | | | |
|---|---|---|---|
| 782323 | 4/1968 | Canada | 126/194 |
| 996233 | 10/1963 | United Kingdom | 126/190 |
| 1072562 | 6/1967 | United Kingdom | 126/194 |

*Primary Examiner*—James C. Yeung

*Attorney, Agent, or Firm*—Carver & Company

[57] ABSTRACT

The assembly includes a container having two side walls, a rear wall, a top wall and a bottom wall which define in part an interior. An openable and closable door is provided for selectively providing access to the interior, the door being able to move between closed, intermediate and open positions. There is a first apparatus, connected to the door and the container, for permitting the door to rotate about a first axis of rotation between the closed and intermediate positions. There is also a second apparatus, cooperating with the first apparatus and the door, for providing a second axis of rotation spaced apart from the first axis, and for permitting lateral movement of the first axis and arcuate movement of the door about the second axis to permit the door to move below the bottom wall of the container.

10 Claims, 10 Drawing Figures

CONTAINER ASSEMBLY

BACKGROUND OF THE INVENTION

The invention relates to a container assembly and, in particular, to an oven assembly.

Ovens and other types of appliances can be found on many ships, trains, planes and, of course, most homes. Typically, the oven includes a door which pivots about a horizontal axis of rotation located near the bottom of the oven. One disadvantage with this type of oven is that it is awkward to open the door when the oven is located in a small area, as is often the case in a galley of a small ship. In addition, it is difficult to leave these types of oven doors open because there is little room for the user to move about.

Commonly, ovens used in ships are mounted on trunnions or "gimbals" to maintain balance of the cooking surface. However, when the oven door is fully opened usually this balance is disturbed.

U.S. Pat. No. 3,456,995 (Nyquist) relates to a slide-in cabinet door which first swings fully open and then slides longitudinally into the cabinet. However, this means that to be swung open, the door must have the same space as a conventional door.

U.S. Pat. No. 2,707,225 (Pearce) discloses a cooking range door opening structure. The range of this reference has two front doors, which are hinged about respective vertical hinge axes and are coupled together to permit simultaneous opening of the doors.

Of general interest in U.S. Pat. Nos. 1,957,800 (Powell) and 2,769,678 (Wolters).

SUMMARY OF THE INVENTION

The invention reduces the difficulties and disadvantages of the prior art by providing an oven with a door that can rotate beneath the oven so that the oven door can be located in a small area which, if an ordinary oven was located, might be "too tight" to fully open the door. Further, the oven is designed so that the balance is essentially maintained when the door is fully opened or fully closed.

The assembly includes a container, such as an oven, having two side walls, a rear wall, a top wall and a bottom wall which define in part an interior. An openable and closable door, operatively connected to the container, is included for selectively providing access to the interior, so that the door can rotate between closed, intermediate and open positions. There is first means, connected to the door and the container, for permitting the door to rotate about a first axis of rotation between the closed and intermediate positions. There is also second means, cooperating with the first means and the door, for providing a second axis of rotation spaced apart from the first axis, and for permitting lateral movement of the first axis and arcuate movement of the door about the second axis to permit the door to move below the bottom wall of the container.

The first axis of rotation has an initial position which is fixed relative to the side walls of the container as the door assumes the intermediate position from the closed position. The second means includes third means for maintaining the first axis parallel to the initial position of the first axis as the first axis moves laterally while the door rotates about the second axis from the intermediate position to assume the open position below the bottom wall of the container.

Preferably, the first means includes a hinge shaft an a pair of connectors. The hinge shaft extends transversely below the bottom wall. The hinge shaft being connected at both ends thereof to the door by the connectors and being operatively connected to the third means.

The assembly may also include two outer side walls and an outer top wall. The second means includes first and second rigid members hingedly connected to each other by a hinge pin, two tracking members and two glide members. The first member is connected to the door and the second member is connected to one of the side walls. The tracking members are disposed parallel to each other. The glide members are connected to opposite ends of the hinge shaft and are adapted to move along the tracking members.

Preferably, there are a pair of first and second rigid members. The members of each pair are hingedly connected to each other by a respective hinge pin.

The second means may include stop means for stopping the rotation of the door about the first axis when the door assumes the intermediate position. The stop means may include a side member connected to at least one of the side walls. The side member is disposed between the first and second rigid member and is adapted to interfere with the hinge pin. In the preferred embodiment, there are two side members and each side member is a flange of a channel forming a part of each of the side walls. Each of the second members is connected to each of the respective flanges.

The third means includes two cross-links which are hinged together by a hinge peg, a transverse rail member and slide members. The transverse rail member extends transversely between the outer side walls. The cross-links are disposed between the hinge shaft and the transverse rail member. The cross-links have adjacent ends connected to the hinge shaft and to the transverse rail member. Opposite ends of the cross-links are connected to the slide members which can slide along the hinge shaft and the transverse rail member respectively, so that the door does not bind against the outer side walls as the door assumes the open position below the bottom wall.

Usefully, the assembly includes a handle apparatus for the door for locking the door in the closed position. The assembly may further include trunnion means for permitting the oven to rotate about a horizontal axis, the trunnion means being connected to the oven so that the latter is essentially balanced when the door is opened or closed. The trunnion means may be used to mount the oven to a ship's interior.

DESCRIPTION OF THE PREFERRED EMBODIMENT

Figure 1:
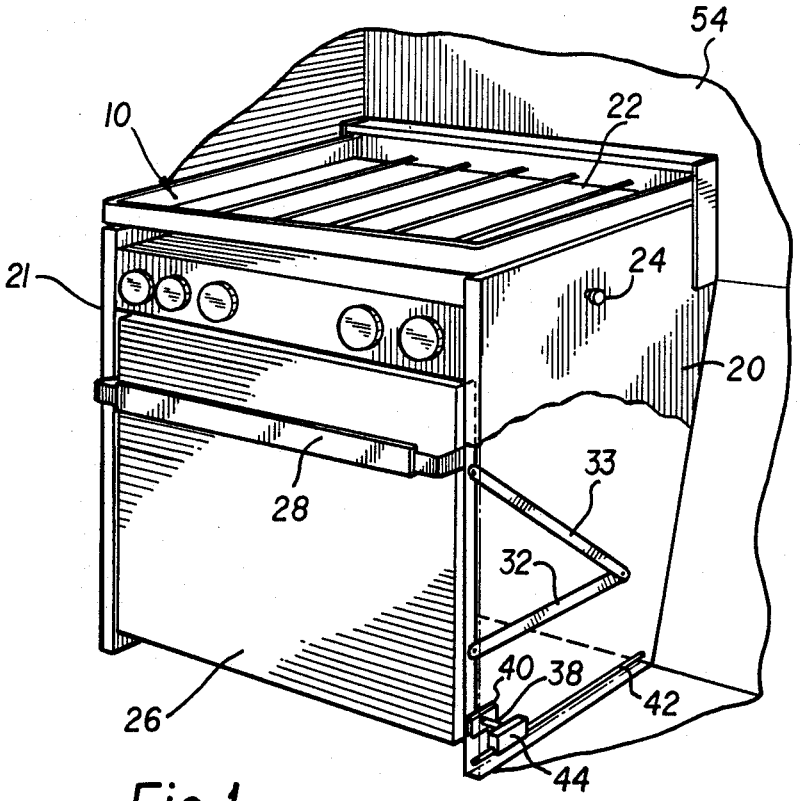
FIG. 1 is a simplified perspective view of an oven assembly according to the invention mounted to a ship's interior showing the door in the closed position, with one side wall fragmented to show part of the inner mechanism.

FIG. 1 shows an oven referred to generally as 10. Oven 10, shown in FIG. 7, has two side walls 12 and 13, a rear wall 14, a top wall 16 and a bottom wall 18 which define in part an interior. The interior of the oven contains means for heating items of food and a thermometer (not shown) for monitoring the temperature in the interior of the oven.

Oven 10 also includes outer side walls 20 and 21 and an outer top wall 22. Located on the outer side walls 20 and 21 are trunnion means 24 and 25 (shown in FIG. 7) for permitting oven 10 to rotate about a horizontal axis so that the oven 10 can retain balance so that the outer top wall 22 remains generally level whether the door is in the open or closed positions. The trunnion means can be used to mount the oven to a ship's interior 54 (shown in FIG. 1).

Oven 10 includes a door 26 for selectively providing access to the interior thereof. Mounted on door 26 is handle 28. Recesses in the handle 28 are engageable with handle stops 30 and 31 (shown in FIG. 7) for locking the door in the closed position. As the user will ordinarily have his hand or hands on handle 28 when the door is in the intermediate position, it is not essential that oven 10 maintain balance and remain level when door 26 is in the intermediate position.

Figure 8:
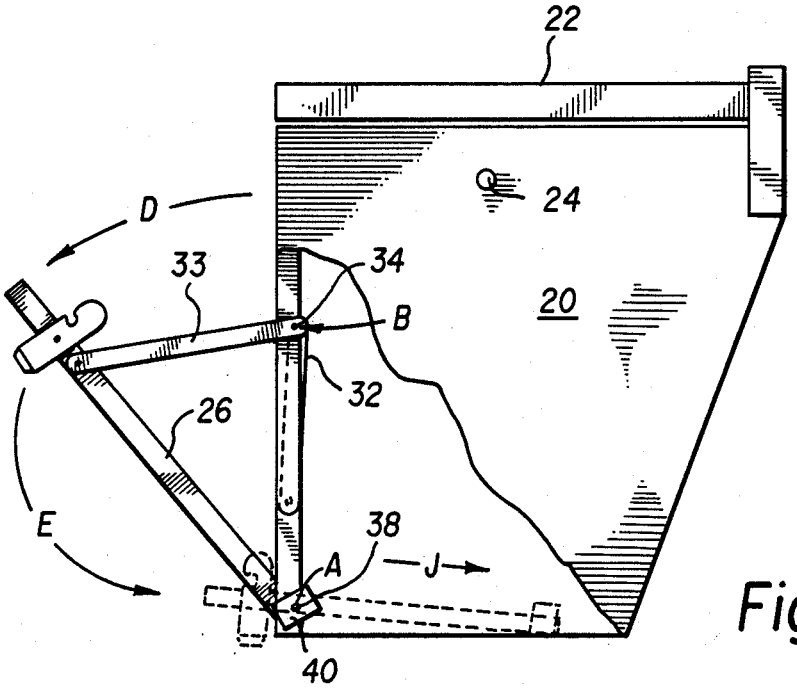
FIG. 8 is a side elevation view of the assembly according to the invention showing the door in the intermediate position, and the first and second axes of rotation.

There is first means, connected to the door 26 and to the oven 10, for permitting the door 26 to rotate about a first axis of rotation A, FIG. 8, between the closed and intermediate positions.

The first means includes a hinge shaft 38 and a pair of connectors 40 and 41. The hinge shaft 38 extends transversely below the bottom wall 18 and is connected adjacent both ends thereof to the door 26 by the connectors 40 and 41.

There is second means, co-operating with the first means and the door 26, for providing a second axis of rotation B (shown in FIG. 8) which is spaced apart from the first axis A, and for permitting lateral movement of the first axis A and arcuate movement of the door 26 about the second axis B to permit the door to move below the bottom wall 18.

Figure 4:
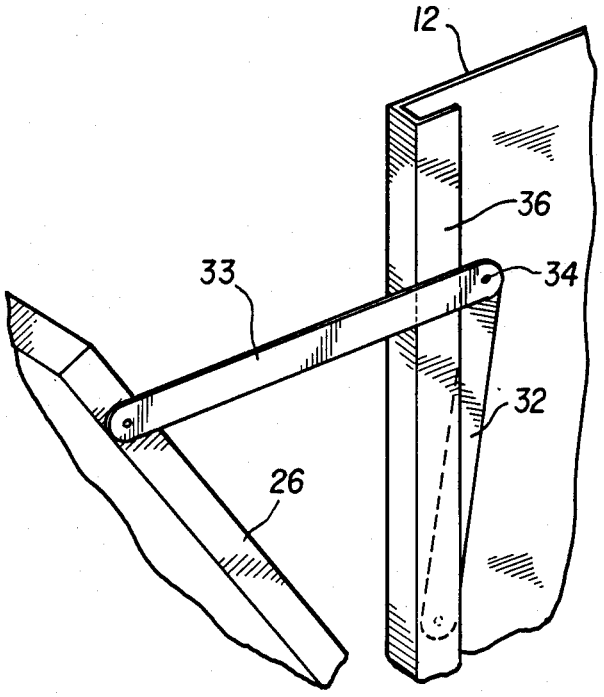
FIG. 4 is a simplified fragmented perspective view of one of the side walls of the assembly of FIG. 3 showing the first and second rigid members and the flange.
Figure 6:
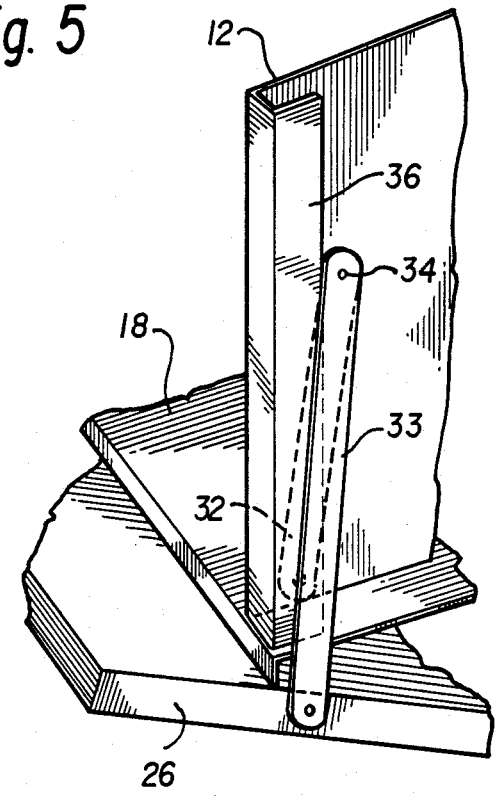
FIG. 6 is a simplified fragmented perspective view of one of the side walls of the assembly of FIG. 5 showing the first and second rigid members and the flange.
Figure 9:
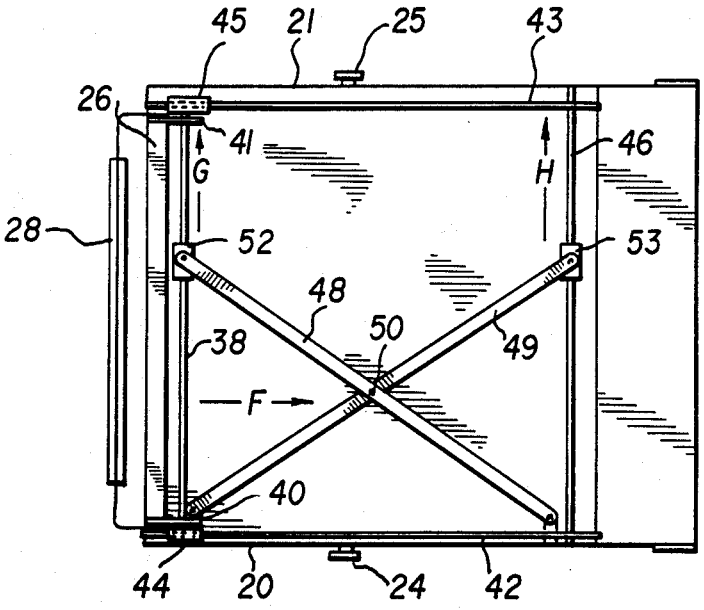
FIG. 9 is a bottom view of the assembly according to the invention showing the door in the closed position and the second and third means.
Figure 10:
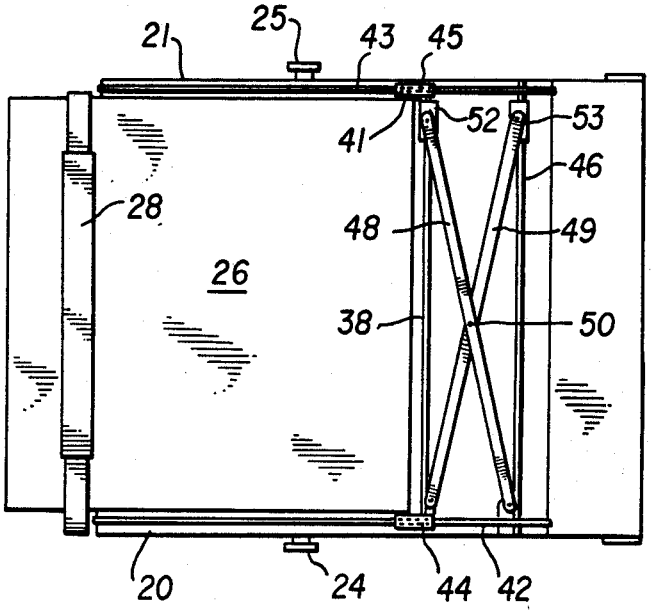
FIG. 10 is a bottom view of the assembly according to the invention showing the door in the open position and showing the second and third means.

The second means includes first and second rigid members 32 and 33, hingedly connected to each other by a hinge pin 34 (shown in FIG. 2), two tracking members 42 and 43 and two glide members 44 and 45 (shown in FIGS. 9 and 10). Preferably, there are two pairs of first and second rigid members 32 and 33. Each first rigid member 32 is slightly shorter than each second rigid member 33. Each first rigid member 32 is hingedly connected to a flange of a channel which forms a part of each side wall, such as flange 36 of side wall 12 (shown in FIGS. 2, 4 and 6). Each second rigid member 33 is hingedly connected to a respective adjacent side of the door 26.

The tracking members are disposed parallel to each other, adjacent respective outer side walls 20 and 21. Glide members 44 and 45 are connected to opposite ends of hinge shaft 38 and are adapted to move along the tracking members 42 and 43 to permit lateral movement of the first axis A and arcuate movement of the door 26 about the second axis B. Preferably the tracking members are polished cylindrical rods and the glide members are low friction plastic blocks with an opening to receive the tracking member to permit essentially free lateral sliding of the hinge shaft between the front and rear of the oven.

Figure 3:
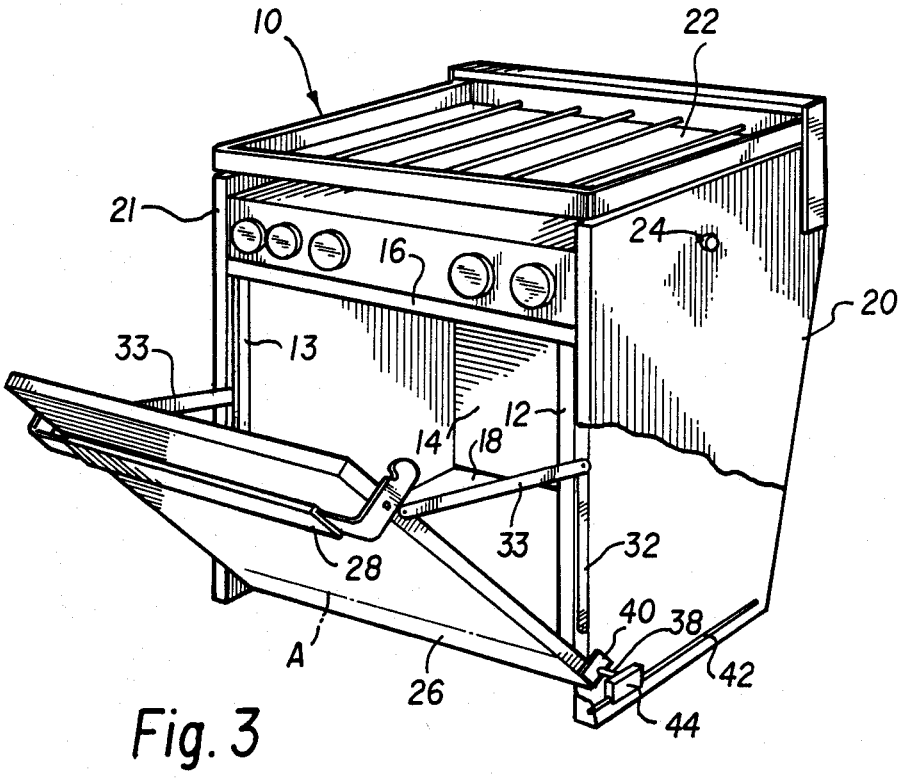
FIG. 3 is a simplified perspective view of the assembly according to the invention showing the door in the intermediate position, with one side wall fragmented to show part of the inner mechanism.

As the door 26 is rotated from the closed position shown in FIG. 1 to the intermediate position shown in FIG. 3, the door rotates substantially less than 90 degrees about the first axis A. The hinge shaft 38 and the pair of first and second rigid members 32 and 33 permit the door 26 to rotate about the first axis A and to assume the intermediate position. During this rotation, the initial position of the first axis A shown in FIG. 8 remains essentially stationary relative to the outer side walls 20 and 21 as the door 26 assumes the intermediate position.

The second means may include third means for maintaining the first axis A parallel to the initial position of the first axis A as the first axis A moves laterally while the door rotates about the second axis B from the intermediate position to assume the open position below the bottom wall 18. The axis A is constrained to move laterally so that the door 26 does not bind against the outer side walls 20 and 21.

The third means includes a pair of cross-links 48 and 49, a transverse rail member 46 and a pair of slide members 52 and 53. The cross-links 48 and 49 are hinged together at a hinge peg 50, and are disposed between the hinge shaft 38 and the transverse rail member 46. The cross-links 48 and 49 have adjacent ends connected adjacent the hinge shaft 38 and the transverse rail member 46. Opposite ends of the cross-links 48 and 49 are connected to slide members 52 and 53 which are adapted to move along the hinge shaft 38 and the transverse rail member 46 respectively. The transverse rail member 46 extends transversely between outer side walls 20 and 21 of the oven, and the slide members 52 and 53 are low friction blocks similar to the glide members 44 and 45.

While the cross-links are shown to maintain the axis A parallel during the lateral movement above, equivalent third means can be substituted.

OPERATION

To open the door 26 thus providing access to the interior of the oven 10, the user would unlock the door 26 by moving the handle 28 in an upward motion, thus disengaging the recesses in the handle 28 from handle stops 30 and 31. The user would then rotate door 26 about the first axis A by pulling handle 28 in the direction of arrow D shown in FIG. 8. By moving door 26 from the closed position shown in FIG. 1 to the intermediate position shown in FIG. 3, first and second rigid members 32 and 33 move from the position shown in FIG. 2 to the position shown in FIG. 4. It can be seen in FIG. 4 that the flange 36 acts to interfere with hinge pin 34 to stop further rotation of door 26 about the first axis A.

Figure 5:
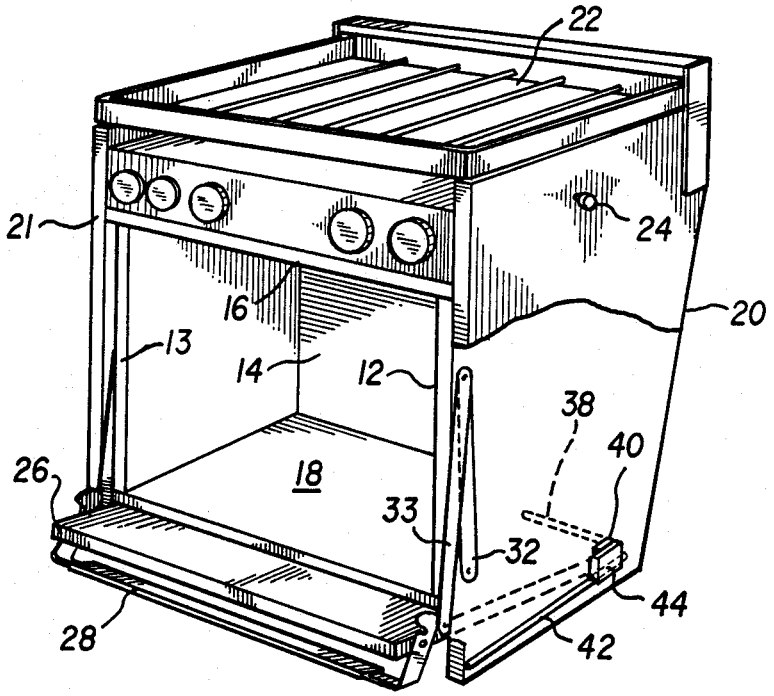
FIG. 5 is a simplified perspective view of the assembly according to the invention showing the door in the open position, with one side wall fragmented to show part of the inner mechanism.

To move door 26 from the intermediate position shown in FIG. 3 to the open position shown in FIG. 5, the user rotates the door about the second axis B in the direction shown by arrow E in FIG. 8 until door 26 is below bottom wall 18. As door 26 rotates about second axis B, first and second rigid members 32 and 33 move from the position shown in FIG. 4 to the position shown in FIG. 6. In addition, as door 26 rotates about second axis B, hinge shaft 38 moves from the position shown in FIG. 9 to the position shown in FIG. 10. It can be seen, from FIGS. 9 and 10, that as door 26 assumes the open position from the intermediate position, glide members 44 and 45 move towards transverse rail member 46, each gliding upon tracking members 42 and 43 respectively, thus moving hinge shaft 38 (and door 26 which is connected thereto by connectors 40 and 41) in the direction shown by arrow F in such a manner that door 26 does not bind against outer side walls 20 and 21. As the door 26 moves from the intermediate position to the open position, slide members 52 and 53 move in the direction shown by respective arrows G and H.

Figure 7:
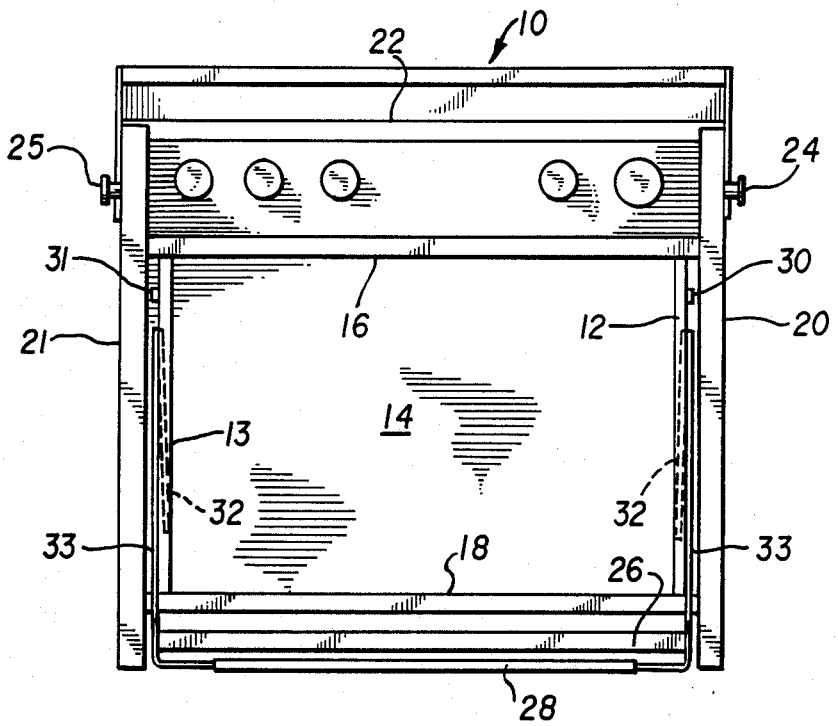
FIG. 7 is a front elevation view of the assembly according to the invention, showing the door in the open position.

It can also be seen from FIG. 7, that when door 26 is in the open position, there is some clearance between door 26 and bottom wall 18. This clearance is necessary to allow the bottom of door 26 to move under bottom wall 18 as door 26 rotates about the second axis B as door 26 moves from the intermediate position to the open position.

The rotation of door 26 has heretofore been described in a two step process for the purpose of simplicity: door 26 is moved from the closed position to the intermediate position as the door rotates about the first axis A, and then door 26 is moved from the intermediate position to the open position as door 26 rotates about the second axis B. It should be noted that due to gravity, the door tends to move to the open position once the user has moved the door to the intermediate position. Thus the door can be moved to the open position with a minimal amount of effort. Alternatively, with some practice the user can easily accomplish a smooth transition between the steps with no pause so the door moves from the closed to the open position in one continuous motion, although the user would have to use more effort to accomplish this result.

Figure 2:
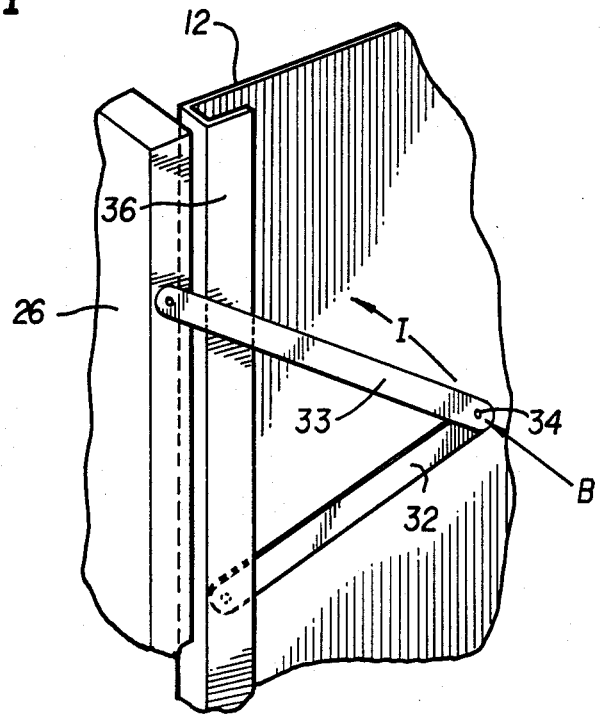
FIG. 2 is a simplified fragmented perspective view of one of the side walls of the assembly of FIG. 1, showing the first and second rigid members and the flange.

In the two step process, the first axis A is stationary and the second axis B moves in the direction shown by arrow I in FIG. 2, as the door moves from the closed to the intermediate position. As the door moves from the intermediate to the open position, the second axis B is stationary and the first axis A moves in the direction shown by arrow J in FIG. 8.

In the alternative process, however, first axis A and second axis B are essentially moving simultaneously; axis A generally moves in the direction shown by arrow J in FIG. 3 and axis B generally moves in the direction shown by arrow I in FIG. 2.

It is to be understood that the invention is not confined to the particular construction and arrangement of parts as herein illustrated and described, but embraces all such modified forms thereof as come within the scope of the following claims.

What is claimed is:

1. A container assembly comprising:

(a) a container having two side walls, a rear wall, a top wall and a bottom wall which define in part an interior;

(b) an openable and closable door operatively connected to the container for selectively providing access to the interior, wherein the door can rotate between closed, intermediate and open positions;

(c) first means, connected to the door and the container, for permitting the door to rotate substantially less than 90 degrees about a first axis of rotation between the closed and intermediate positions; and (d) second means, cooperating with the first means and the door, for providing a second axis of rotation spaced apart from the first axis, and for permitting lateral movement of the first axis and arcuate movement of the door about the second axis to permit the door to move below the bottom wall of the container, wherein the first axis of rotation has an initial position which is fixed relative to the side walls of the container as the door assumes the intermediate position from the closed position;

(e) the second means including a third means for maintaining the first axis parallel to the initial position of the first axis as the first axis moves laterally while the door rotates about the second axis of rotation from the intermediate position to assume the open position below the bottom wall of the container.

2. A container assembly as claimed in claim 1, wherein the first means includes a hinge shaft and a pair of connectors, the hinge shaft extending transversely below the bottom wall, the hinge shaft being connected at both ends thereof to the door by the connectors, and being operatively connected to the third means.

3. A container assembly as claimed in claim 2, wherein the container includes two outer side walls and an outer top wall and the second means includes first and second rigid members hingedly connected to each other by a hinge pin, two tracking members and two glide members, the first member being connected to the door and the second member being connected to one of the side walls, the tracking members being disposed parallel to each other, the glide members being connected to opposite ends of the hinge shaft and being adapted to move along the tracking members.

4. A container assembly as claimed in claim 3, wherein there are a pair of first and second rigid members, the members of each pair being hingedly connected to each other by a respective hinge pin, each of said first members being connected to the door and each of said second members being connected to the respective side wall.

5. A container assembly as claimed in claim 3, wherein the second means includes stop means for stopping the rotation of the door about the first axis of rotation when the door assumes the intermediate position, said stop means being located adjacent the side walls of the container.

6. A container assembly as claimed in claim 5, wherein the stop means includes a side member connected to at least one of the side walls of the container, the side member being disposed between the first and second rigid members and adapted to interfere with the hinge pin to stop further rotation of the door about the first axis of rotation as the door assumes the intermediate position.

7. A container assembly as claimed in claim 6, wherein the side member is a flange of a channel forming a part of one of the side walls and wherein the second member is connected to the flange.

8. A container assembly as claimed in claim 3, wherein the third means includes two cross-links which are hinged together by a hinge peg, a transverse rail member and slide members, said transverse rail member extends between the outer side walls, said cross-links being disposed between the hinge shaft and the transverse rail member, said cross-links having adjacent ends connected to the hinge shaft and to the transverse rail member and having opposite ends connected to the slide members which can slide along the hinge shaft and the transverse rail member respectively, so that the door does not bind against the outer walls as the door assumes the open position below the bottom wall.

9. An oven assembly comprising:

(a) an oven having two side walls, a rear wall, a top wall and a bottom wall which define in part an interior and two outer side walls and an outer top wall;

(b) openable and closable door operatively connected to the oven for selectively providing access to the interior, wherein the door can rotate between closed, intermediate and open positions;

(c) a hinge shaft connected to the door by a pair of connectors for permitting the door to rotate about a first axis of rotation between the closed and intermediate positions;

(d) a pair of first and second rigid members, the members of each pair being hingedly connected to each other by a respective hinge pin, each of said first members being connected to the door and each of said second members being connected to the respective side wall, the pair of first and second rigid members being adapted to provide a second axis of rotation, spaced apart from the first axis, and for permitting arcuate movement of the door about the second axis to permit the door to move below the bottom wall of the container;

(e) two side members, each of which is connected to the respective side wall, each side member being disposed between the first and second rigid members and being adapted to interfere with the hinge pin to stop further rotation of the door about the first axis as the door assumes the intermediate position;

(f) two cross-links which are hinged together near a mid-point of each cross-link, a transverse rail member and a pair of slide members, the transverse rail member extends transversely between the outer side walls, the cross-links being disposed between the hinge shaft and the transverse rail member, said cross-links having adjacent ends connected to the hinge shaft and the transverse rail member and having opposite ends connected to the slide members which can slide along the hinge shaft and the transverse rail member respectively;

(g) two tracking members and two glide members, wherein the tracking members are disposed parallel to each other, said glide members being connected to opposite ends of the hinge shaft and being adapted to glide along the tracking members so that as the door rotates about the second axis while the first axis moves laterally, the door does not bind against the outer side wall as the door assumes the open position below the bottom wall;

(h) a handle apparatus for the door for locking the door in the closed position; and (i) trunnion means for permitting the oven to rotate about a horizontal axis, the trunnion means being connected to the oven so that the latter is balanced when the door is open or closed.

10. In combination, an oven assembly mounted in a ship's interior comprising:

a ship's interior, an oven assembly mounted in the ship's interior, said oven assembly comprising, (a) an oven having two side walls, a rear wall, a top wall and a bottom wall which define in part an interior and two outer side walls and an outer top wall;

(b) an openable and closable door operatively connected to the oven for selectively providing access to the interior, wherein the door can rotate between closed, intermediate and open positions;

(c) a hinge shaft connected to the door by a pair of connectors for permitting the door to rotate about a first axis of rotation between the closed and intermediate positions;

(d) a pair of first and second rigid members, the members of each pair being hingedly connected to each other by a respective hinge pin, each of said first members being connected to the door and each of said second members being connected to the respective side wall, the pair of first and second rigid members being adapted to provide a second axis of rotation, spaced apart from the first axis, and for permitting arcuate movement of the door about the second axis to permit the door to move below the bottom wall of the container;

(e) two side members, each of which is connected to the respective side wall, each side member being disposed between the first and second rigid members and being adapted to interfere with the hinge pin to stop further rotation of the door about the first axis as the door assumes the intermediate position;

(f) two cross-links which are hinged together near a mid-point of each cross-link, a transverse rail member and a pair of slide members, the transverse rail member extends transversely between the outer side walls, the cross-links being disposed between the hinge shaft and the transverse rail member, said cross-links having adjacent ends connected to the hinge shaft and the transverse rail member and having opposite ends connected to the slide members which can slide along the hinge shaft and the transverse rail member respectively;

(g) two tracking members and two glide members, wherein the tracking members are disposed parallel to each other, said glide members being connected to opposite ends of the hinge shaft and being adapted to glide along the tracking members so that as the door rotates about the second axis while the first axis moves laterally, the door does not bind against the outer side wall as the door assumes the open position below the bottom wall;

(h) a handle apparatus for the door for locking the door in the closed position; and (i) trunnion means for permitting the oven to rotate about a horizontal axis, the trunnion means being connected to the oven so that the latter is balanced when the door is open or closed.

* * * * *